US006684679B2

(12) United States Patent
Hsieh

(10) Patent No.: US 6,684,679 B2
(45) Date of Patent: Feb. 3, 2004

(54) PNEUMATIC METAL-WORK TOOL

(76) Inventor: Yu-Fu Hsieh, P.O. Box 96-405, Taipei 106 (TW)

( * ) Notice: Subject to any disclaimer, the term of this patent is extended or adjusted under 35 U.S.C. 154(b) by 0 days.

(21) Appl. No.: 10/157,856

(22) Filed: May 31, 2002

(65) Prior Publication Data

US 2003/0221475 A1 Dec. 4, 2003

(51) Int. Cl.[7] ..... B26B 17/00; B21D 28/20

(52) U.S. Cl. ..... 72/453.15; 72/453.16; 30/180; 30/241; 29/751

(58) Field of Search ..... 72/453.15, 453.16, 72/432, 441, 453.02, 416; 30/180, 182, 228, 241; 81/301; 29/751, 750

(56) References Cited

U.S. PATENT DOCUMENTS 2,776,481 A * 1/1957 Northcutt ..... 30/180
2,941,430 A * 6/1960 Klinger ..... 72/453.16
3,263,481 A * 8/1966 Boyd et al. ..... 72/453.16
3,733,699 A * 5/1973 Bock ..... 30/180
4,382,331 A * 5/1983 Kimura ..... 30/180
5,282,378 A * 2/1994 Kimura ..... 72/453.16
5,425,164 A * 6/1995 El Dessouky ..... 72/453.16
5,666,848 A * 9/1997 Burns ..... 72/453.16
5,979,215 A * 11/1999 Lefavour et al. ..... 72/453.16

* cited by examiner

*Primary Examiner*—David Jones
(74) *Attorney, Agent, or Firm*—Troxell Law Office PLLC

(57) ABSTRACT

A pneumatic metal-work tool includes a punch assembly mounted on the front end of a hydraulic push-rod assembly. The hydraulic push-rod assembly has a hydraulic chamber mounted with a piston rod. One end of the piston rod is mounted in a center hole of a piston. When the control valve of the metal-work tool has a high pressure air entered the casing to drive the piston to move, the pressure air will be converted into a hydraulic force via the hydraulic chamber so as to have the hydraulic push rod provide a punch force, and to have a metal sheet in the opening of the punch assembly punched with a hole.

10 Claims, 10 Drawing Sheets

PNEUMATIC METAL-WORK TOOL

BACKGROUND OF THE INVENTION

1. Field of the Invention

This invention relates to a metal-work tool, and particularly to a pneumatic metal-work tool for punching hole and edging a metal sheet.

2. Description of the Prior Art

A conventional pneumatic metal-work tool comprises a casing mounted with a piston and a piston rod; one end of the piston rod extends into a hydraulic chamber on the front end of the casing; the hydraulic chamber is mounted with a push rod extended out of the same; one end of the push rod is connected with a punch assembly; as soon as the pressure air enters the casing, the pressure air will drive the piston to move; then, the piston rod in the hydraulic chamber will be pushed in to provide a pressure, which causes the push rod to move and to drive a punch assembly to punch a hole in a metal sheet; the hydraulic chamber in the front end of the casing is used for converting a pneumatic force into a hydraulic force, which can provide a steady and high punching force; however, after the tool is used for a long time, a leakage might take place between the hydraulic chamber and the cylinder; in that case, the punching force of the hydraulic pushing force converted from the pressure air might be reduced; consequently, a calibration to the pressure must be done after the oil being replenished to the hydraulic chamber.

SUMMARY OF THE INVENTION

The prime object of the present invention is to provide a pneumatic metal-work tool, in which the outer surface of the push rod is mounted with a spring, of which one end is pushed against a threaded base, while other end thereof is pushed against a ring-shaped plate to provide the push rod with a return force. The hydraulic chamber is filled with oil, and one end of the piston rod extends into the hydraulic chamber; as long as the hydraulic chamber is filled with oil over one half of its volume, the hydraulic chamber will have no residual air. When the piston rod is driven with the pressure air, the hydraulic chamber will convert that force into a steady punch force to enable the punch assembly to work.

Another object of the present invention is to provide a pneumatic metal-work tool, in which one end of the round rod of the push rod extends into a cylindrical hole of a threaded base, while the other end thereof has a ring-shaped plate with a larger diameter; a round rod on the other end of the ring-shaped plate is mounted with an o-ring and a ring seal; the cylindrical hole for mounting the push rod is partitioned into two spaces, of which one space is mounted with a spring, and one end of the spring is pushed against the ring-shaped plate so as to provide the push rod with a return force; the other space thereof is in communication with the hydraulic chamber of the push rod; the two spaces are separated by means of the o-ring so as to prevent from oil leakage. When the piston rod is pushed towards the hydraulic chamber of the push rod, the oil in the hydraulic chamber will be expanded in one direction as a result of pressure so as to provide the push rod with a punching force.

Still another object of the present invention is to provide a pneumatic metal-work tool, in which the push rod of the metal-work tool is mounted with a connection pipe; one end of the push rod has a threaded portion to be engaged together with a threaded base; the center of the threaded base has a cylindrical hole mounted with an oil seal, a buffer washer and a piston rod; the buffer washer is to provide a shock-proof function upon the push rod returning, and to prevent oil from infiltrating into the center chamber of the casing.

A further object of the present invention is to provide a pneumatic metal-work tool, in which the push rod is mounted with a connection pipe, and one end thereof is mounted with a threaded base, of which the outer end of a ring-shaped plate is in contact with the end thereof, while the outer end thereof is mounted with a threaded sleeve; the center of threaded base has a threaded hole to be mounted with a threaded portion of the punch assembly; different diameters of punch holes of the punch assembly can be replaced by means of disassembling the threaded portion.

A still further object of the present invention is to provide a pneumatic metal-work tool, in which one end of the C-shaped base in the punch assembly has a threaded cylinder, which is screwed in a threaded base of the hydraulic push-rod assembly; the center of the threaded cylinder has a cylindrical hole for receiving a punch shaft of a guide shaft; one end of the punch shaft has a round shaft will a smaller diameter, and one end of the round shaft is inserted into a cylindrical hole of the guide sleeve; the punch shaft is mounted with a spiral spring, which can provide the punch shaft with a returning force after each punching.

Yet another object of the present invention is to provide a pneumatic metal-work tool, in which the threaded cylinder of the C-shaped base in the punch assembly is mounted in a threaded hole of a threaded base of the hydraulic push-rod assembly; the threaded portion of the threaded cylinder is mounted with a threaded positioning ring; the spring of the C-shaped base is fixed in place with the threaded positioning ring after the direction being adjusted as desired so as to have he punch assembly fastened in place.

Yet still another object of the present invention is to provide a pneumatic metal-work tool, in which one side of the C-shaped base of the punch assembly has an opening; both sides of the opening are mounted with a guide sleeve and a punch base respectively; the guide sleeve is mounted to one end of the punch shaft; the center of the punch base has a punch hole, which is used for punching a hole in a metal sheet upon the metal-work tool being operated.

Yet a further object of the present invention is to provide a pneumatic metal-work tool, in which one side of the C-shaped base of the metal-work tool is mounted with a guide sleeve and a punch base by means of threaded portion of a threaded base; the C-shaped base can be removed if necessary so as to replace a punch shaft, a guide sleeve and a punch base having different diameter.

Yet still a further object of the present invention is to provide a pneumatic metal-work tool, in which the threaded base on the front end of the metal-work tool is mounted with a punch assembly by means of threads; both sides of the opening of the C-shaped base are mounted with punch assemblies so as to punch a hole in a metal sheet.

Yet still a further object of the present invention is to provide a pneumatic metal-work tool, in which the front end of the metal-work tool has a threaded base to be mounted with a punch assembly; both sides of the C-shaped base are furnished with edging assemblies so as to edge one end of a metal sheet.

DETAILED DESCRIPTION OF THE PREFERRED EMBODIMENTS

Figure 1:
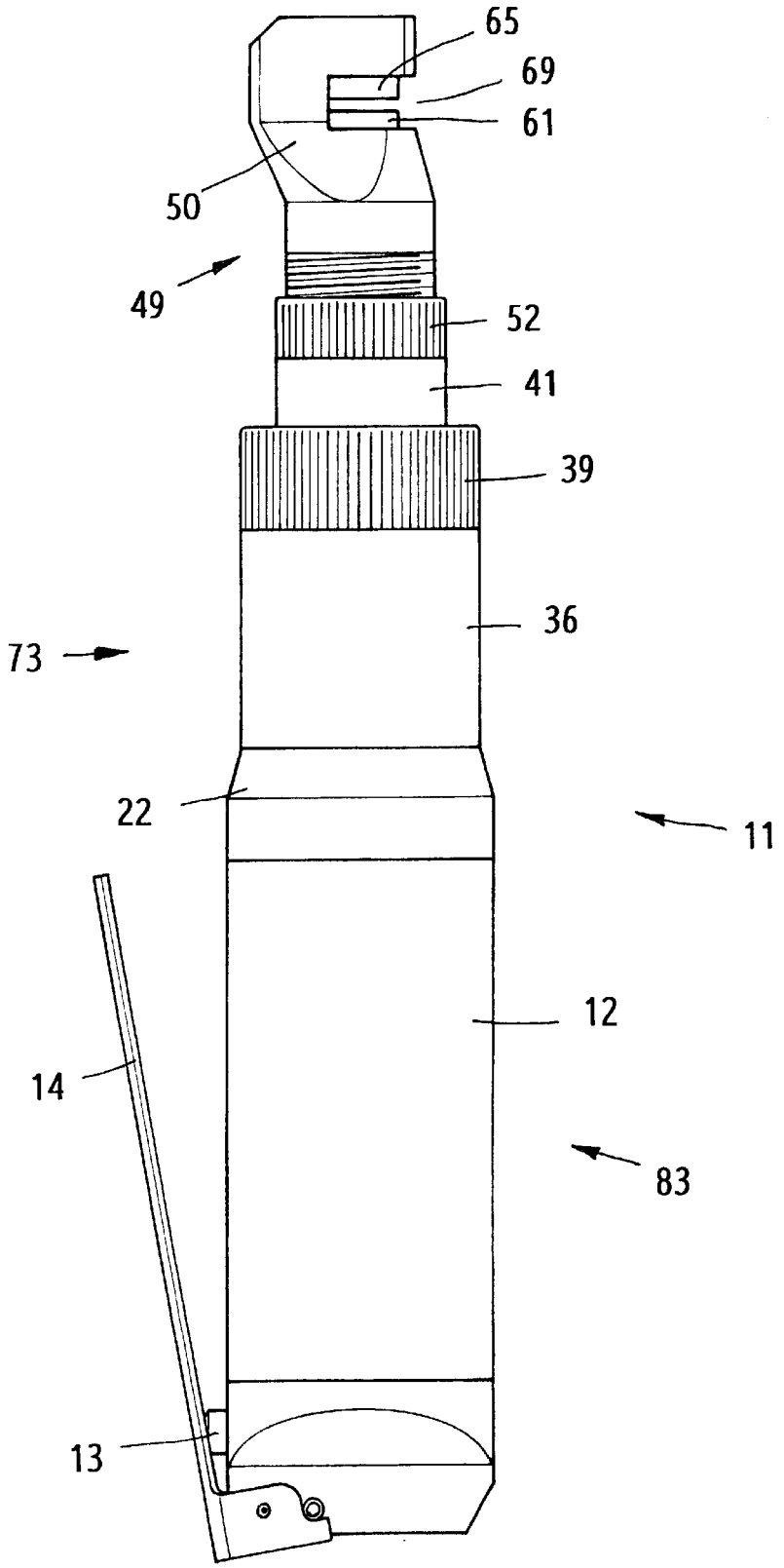
FIG. 1 is a plan view of the present invention.
Figure 2:
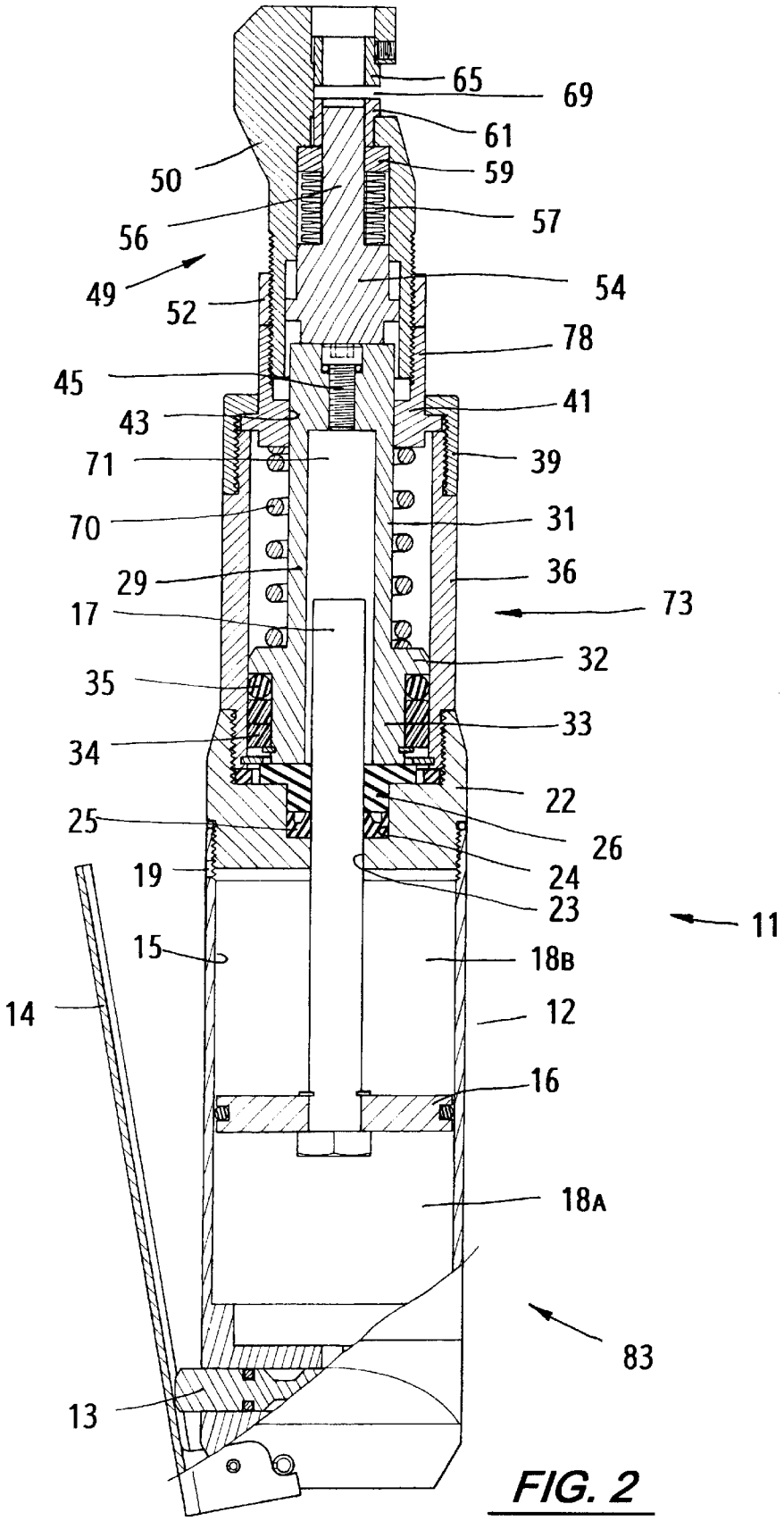
FIG. 2 is a sectional view of the present invention, showing the inner structure of the metal-work tool.

This invention relates to a pneumatic metal-work tool; as shown in FIGS. 1 and 2, the metal-work tool 11, comprises a body assembly 83, a hydraulic push-rod assembly 73 and a punch assembly 80 or an edging assembly 81. The body assembly 83 includes a piston 16 and a piston rod 17 mounted in a round casing 12; one end of the casing 12 mounted with a control valve 13; when a cock 14 is pressed, high pressure air will flow into the chamber A of a cylindrical hole 15; upon the piston 16 being moved, the piston rod 17 will move into the hydraulic chamber 71 of a hydraulic push-rod assembly 73. When the piston rod 17 moves towards the hydraulic chamber 71, the piston rod 17 will enter the hydraulic chamber 71 to have a liquid in the hydraulic chamber 71 moved towards the push rod 29 so as to provide a hydraulic punch force, and to have the punch assembly 49 punch a hole or edge a sheet.

Referring to FIGS. 1, 2, 8 and 9, the body assembly 83 of the metal-work tool 11 includes a casing 12, a threaded base 22, a control valve 13, a cock 14, a piston 16, a piston rod 17, a connection pipe 36 and a threaded sleeve 39; one end of the casing 12 is mounted with a control valve 13 and a cock 14; one side thereof is connected with a high pressure pipe which is connected with an air compressor. The other end of the casing 12 has a cylindrical hole 15, of which the end has a threaded base 22 with a threaded hole 20; the center of the threaded base 22 has a cylindrical hole 24 for mounting an oil seal 25 and a buffer washer 26; the other end of the threaded base 22 has a threaded hole 28 to connect with a connection pipe 36, of which the other end is mounted with a threaded base 41 to be mounted with a threaded sleeve 39. The outer end of the threaded base 41 has a threaded hole 68 to be connected and fixed with a punch assembly 49; the metal-work tool 11 has an outer casing to facilitate the inner assemblies to mount in place and to guide during moving.

The threaded hole 20 at one end of the casing 12 is used for receiving a threaded base 22, of which the center is furnished with two cylindrical holes 23 and 24; the cylindrical hole 23 is to be mounted with the piston rod 17, while the cylindrical hole 24 is to be mounted with an oil seal 25 and a buffer washer 26. The centers of the oil seal 25 and the buffer washer 26 are furnished with cylindrical holes 27A and 27B respectively so as to let the piston rod 17 pass through, and to provide an oil seal function. The cylindrical hole 15 in the casing 12 is mounted with a piston 16 with a piston rod 17; the cylindrical hole 15 is divided with the piston 16 into two separate chambers 18A and 18B; the chamber 18A is in communication with the passage of the control valve 13, which is controlled and pressed with a cock 14 so as to have a high pressure air entered chamber 18A, and to push the piston 16 and the piston rod 17 to move. The air in the chamber 18B will be exhausted via an exhausting hole 19. The piston rod 17 can be pushed through a cylindrical hole 23 of the threaded base 22, the oil seal 25, the cylindrical holes 27A and 27B of the buffer washer 26, and the hydraulic chamber 71 of the push rod 29. The cross area of the control valve 13 is controlled with the cock 14 so as to push the piston rod 17 to move; upon the high pressure air pushing the piston 16 to move, the piston rod 17 in the hydraulic chamber 71 will be pushed to move to provide a hydraulic force as a result of the expansion volume of oil in the hydraulic chamber 71, and then the punch assembly 49 in the metal-work tool 11 will have a punching force.

The threaded hole 20 of the casing has a threaded base 22, of which the center cylindrical hole 24 is mounted with an oil seal 25 and a buffer washer 26; the cylindrical holes 27A and 27B of the oil seal 25 and the buffer washer 26 are mounted with the piston rod 17. The seal 25 is used for partitioning the chamber 18B and the hydraulic chamber 71 of the connection pipe 36 so as to prevent the oil in the hydraulic chamber 71 from leakage. The buffer washer 26 outside the oil seal 25 is a cascade washer, and the outer diameter thereof is slightly larger than that of the round rod 33 of the push rod 29 so as to reduce vibration and noise of the casing upon the push rod 29 being pushed back with a spring 70.

Figure 7:
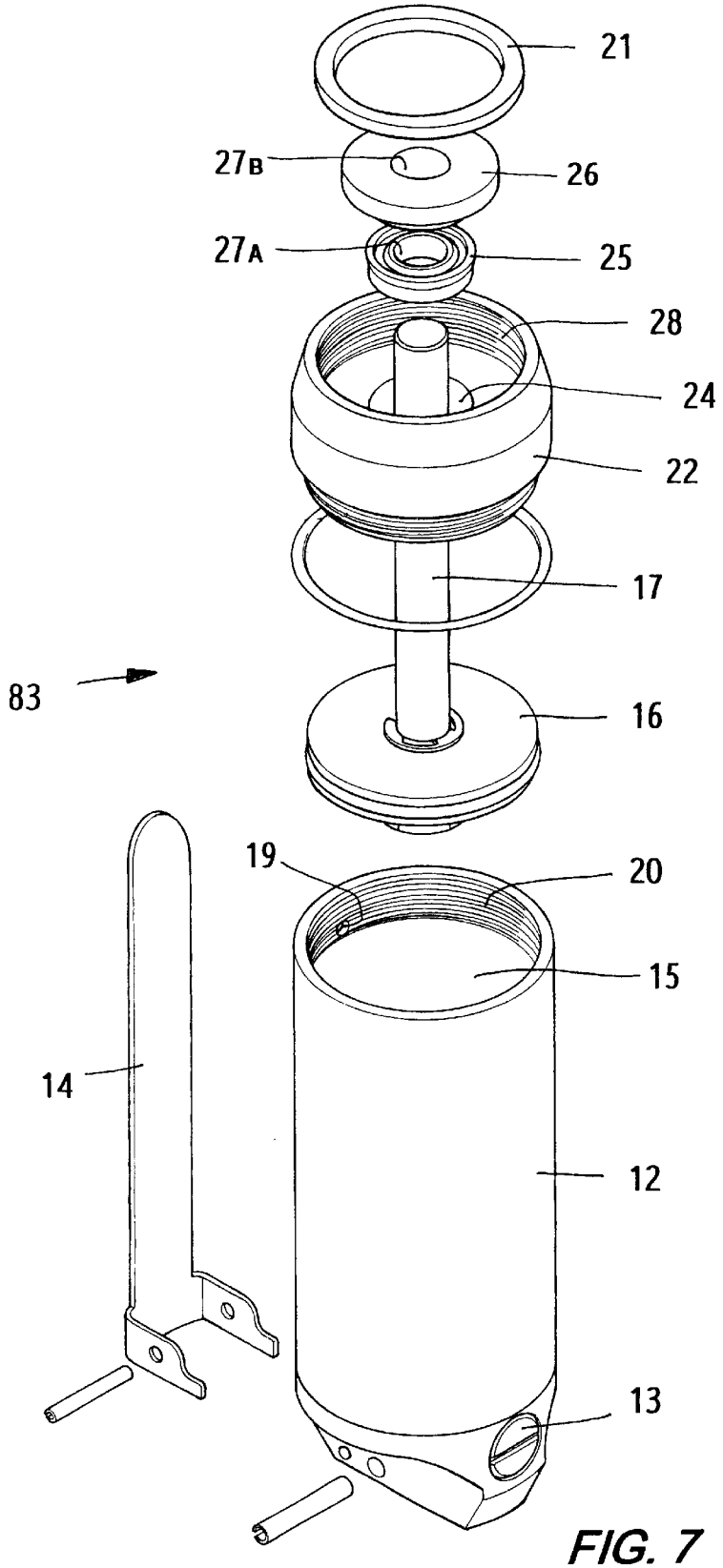
FIG. 7 is a disassembled view of the present invention, showing the related structure of the hydraulic push-rod assembly.
Figure 8:
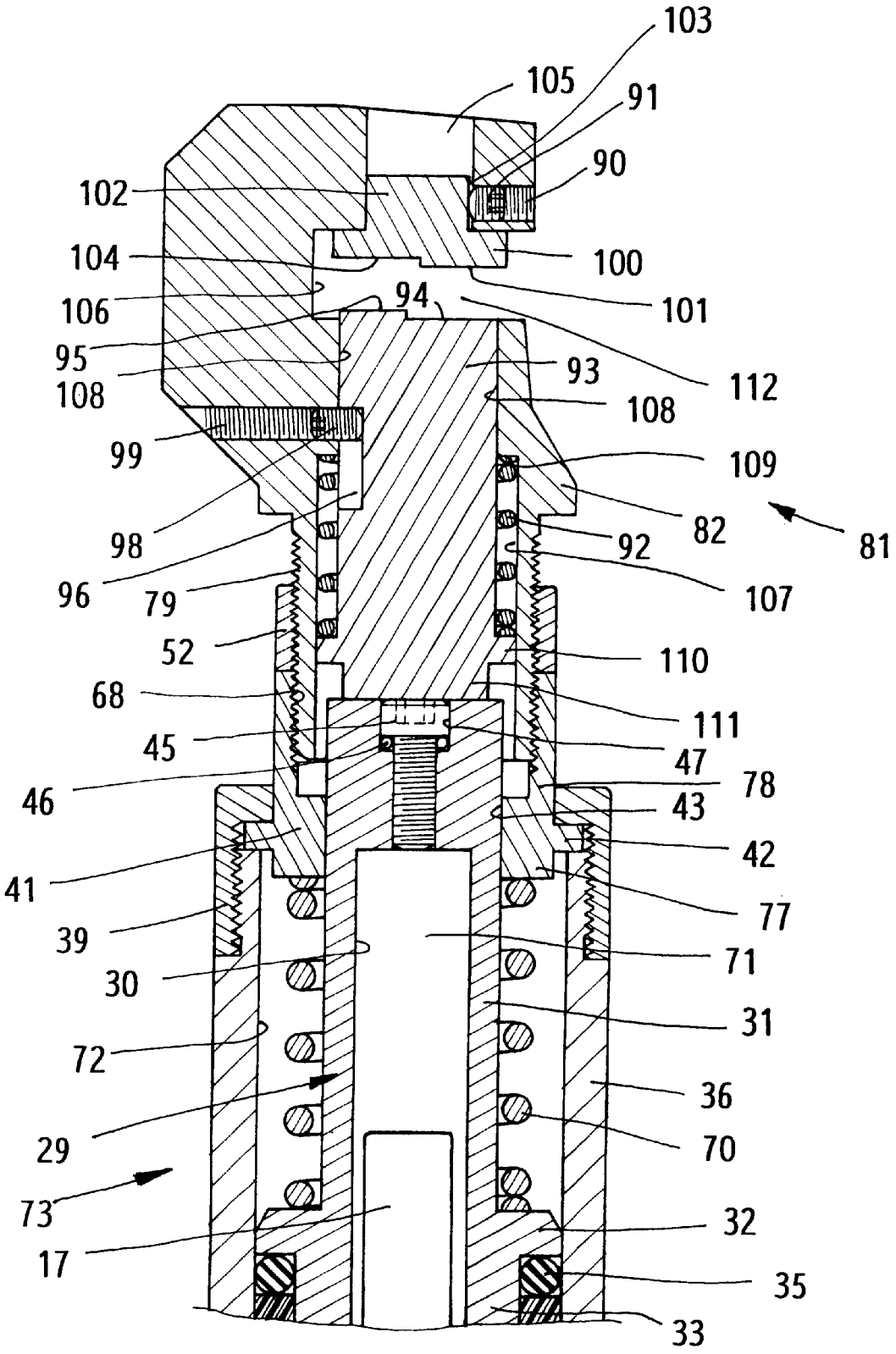
FIG. 8 is a sectional view of the present invention, showing the related structure of the body assembly.
Figure 9:
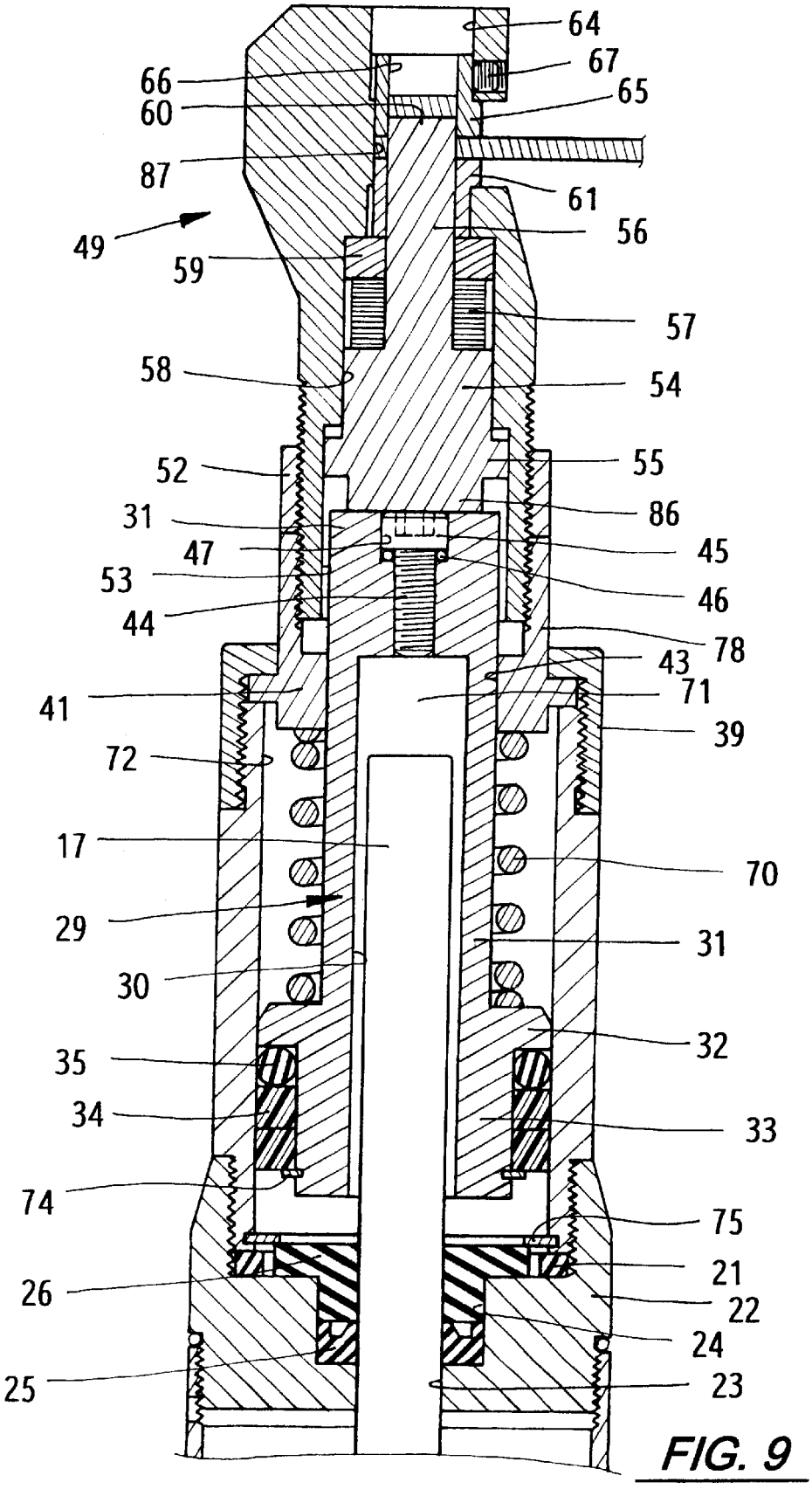
FIG. 9 is a sectional view of the present invention, showing the operation condition of the metal-work tool.
Figure 10:
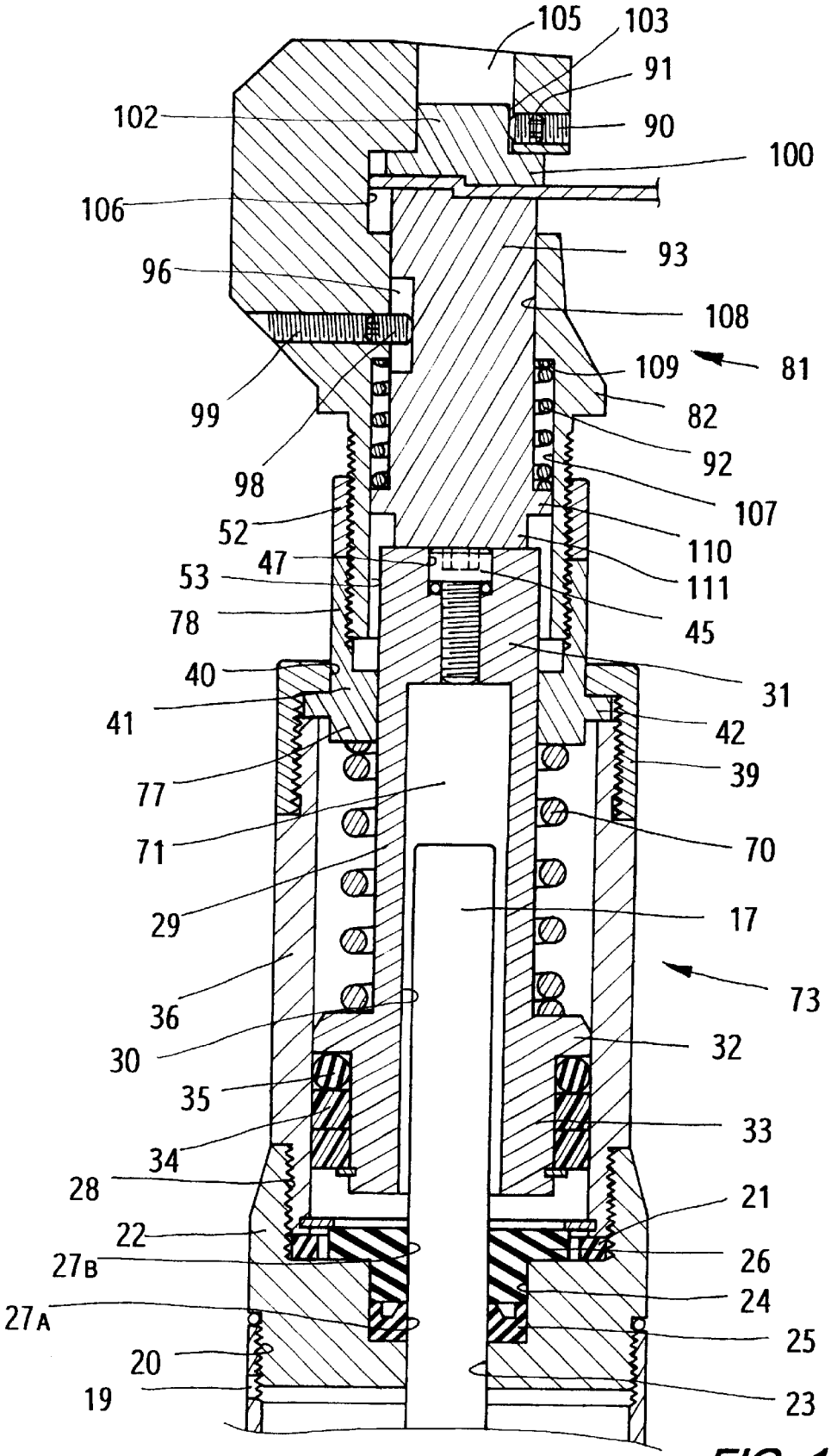
FIG. 10 is a sectional view of the present invention, showing the operation condition of the edging tool.

The threaded hole 28 of the threaded base 22 has a ring groove mounted with a washer 21, which enables the threaded rod 37 of the connection pipe 36 to be mounted and screwed in the threaded hole 28 of the threaded base 22; then, the threaded rod 37 and the washer 21 will be connected closely together so as to prevent the oil in the cylindrical hole 72 of the threaded rod 37 from leakage; before the connection pipe 36 being mounted in the threaded hole 28 of the threaded base 22, the hydraulic push-rod assembly 73 in the cylindrical hole 72 must be assembled first. As shown in FIGS. 2 and 7, the cylindrical hole 72 of the connection pipe 36 should be mounted with a hydraulic push-rod assembly 73 before the connection pipe 36 and the threaded base 22 being connected together; the hydraulic push-rod assembly 73 includes a connection pipe 36, a push rod 29, an O-ring 35, a ring seal 34, a retaining ring 74, a spring 70, a threaded base 41, a threaded sleeve 39, a threaded bolt 45 and an O-ring 46. Both ends of the connection pipe 36 are furnished with two threaded rods 37 and 76 respectively, and the center thereof has a cylindrical hole 72. The threaded rod 37 is to be mounted in the threaded portion 38 of the threaded base 22; the cylindrical hole 72 of the threaded rod 76 is mounted on the threaded base 41, and then a threaded sleeve 39 is mounted on the threaded rod 76 of the connection pipe 36. The center of the threaded base 41 has a cylindrical hole 43 for receiving a round rod 31 with a guide function. The push rod 29 has a ring-shaped plate 32, of which the round rod 31 at one end is mounted with a spring 70; one end of the spring 70 is in contact with the ring-shaped plate 32, while the other end thereof contacts against one end of the short rod 77 of the threaded base 41 so as to provide the push rod 29 with a return force. The round rod 33 of the ring-shaped plate 32 is mounted with an O-ring 35 and a ring seal 34; the outer end thereof is mounted with a retaining ring 74 so as to fasten the aforesaid parts in place. The push rod 29 is mounted in the cylindrical hole 72 of the connection pipe 36; a retaining ring 75 is mounted at the other end of the cylindrical hole 72 of the threaded rod 37 so as to prevent the push rod 29 of the hydraulic push-rod assembly 73 from separation.

The threaded base 41 mounted on the cylindrical hole 72 of the threaded rod 76 of the connection pipe 36 has a ring-shaped plate 42 on the outer and lower part thereof; a short rod 77 is furnished under the ring-shaped plate 42; the diameter of the short rod 77 is slightly smaller than that of cylindrical hole 72 of the connection pipe 36 so as to facilitate the short rod 77 to be mounted in the cylindrical hole 72 of the connection pipe. The bottom surface of the ring-shaped plate 42 is in correct with the end of the threaded rod 76, while the outer surface of the ring-shaped plate 42 of the threaded base 41 has a round rod 78 to be mounted with the threaded sleeve 39; the threaded sleeve 39 is furnished with a threaded portion 38 to enable the same to mount to the threaded rod 76 of the connection pipe 36. The center of the round rod 78 of the threaded base 41 has a threaded hole 68 and a cylindrical hole 43; the threaded hole 68 is used for mounting a threaded cylinder 79 of the punch assembly 49. The cylindrical hole 43 is used for receiving the round rod 31 of the push rod 29; when the hydraulic push-rod assembly 73 is actuated, the rod 29 can be guided to move so as to push the guide shaft 54 of the punch assembly 49 to move.

The threaded base 41 has a ring-shaped plate 42, and the threaded sleeve 39 of the round rod 78 has a contact surface which has a round hole 40. The inner surface of the threaded sleeve 39 is furnished with a threaded portion 38 to be engaged with the threaded rod 76 of the connection pipe 36; after the threaded base 41 is mounted on the connection pipe 36, the push rod 29 in the cylindrical hole 43 of the threaded base 41 can move back and forth under a guide direction.

The push rod 29 of the hydraulic push-rod assembly 73 is mounted in the cylindrical hole 72 of the connection pipe 36, and the push rod 29 has a ring-shaped plate 32, of which the diameter is equal to that of the cylindrical hole 72; one end of the ring-shaped plate 32 has a round rod 31 with a smaller diameter, which is equal to that of the cylindrical hole 43 of the threaded base 41. Upon assembling, the round rod 31 of the push rod 29 is mounted in the cylindrical hole 43 of the threaded base 41; the round rod 31 of the push rod 29 is fitted in a spring 70; both ends of the spring 70 are in contact with the ring-shaped plate 32 and the short rod 77 of the threaded base 41 respectively so as to enable the push rod 29 to return upon being moved.

The other end of the ring-shaped plate 32 of the push rod 29 has a round rod 33 with a smaller diameter; the round rod is to be mounted through the O-ring 35 and a plurality of ring seals 34; the outer end of the round rod 33 is furnished with a groove for a retaining ring 74 so as to prevent the ring seals 34 and the O-ring 35 from separation. One end of the push rod 29 facing the threaded base 22 is furnished with an elongate cylindrical hole 30, of which the diameter is larger than that of the piston rod 17 for receiving the piston rod 17; the other end of the push rod 29 is furnished with a cylindrical hole 47 and a threaded hole 44; a threaded bolt 45 mounted with an O-ring 46 is screwed in the threaded hole 44; the O-ring 46 is used for preventing leakage.

Before assembling the push rod 29 and the connection pipe 36, the short rod 77 of the threaded base 41 should be fitted in the cylindrical hole 72 of the connection pipe 36, and then the ring-shaped plate 42 is in close contact with the end of the connection pipe 36; then, the round hole 40 of the threaded sleeve 39 is mounted on the round rod 78 of the threaded base 41; the threaded portion 38 is engaged with the threaded rod 76 of the connection pipe 36 so as to have threaded base 41 fixed to the outer end of the connection pipe 36. After the round rod 33 of the push rod 29 is mounted with an O-ring 35 and a ring seal 34, the round rod 33 is mounted with a retaining ring 74 in the retaining ring groove so as to fix the ring seal 34 and O-ring 35 on the round rod 33. The round rod 31 under the ring-shaped plate 32 is mounted with a spring 70, and then the round rod 31 of the push rod 29 is fitted in the cylindrical hole 72 of the connection pipe 36; then, the round rod is mounted through the cylindrical hole 43 of the threaded base 41; one end of the cylindrical hole 72 of the connection pipe 36 has a retaining ring groove for receiving a retaining ring 75 upon the push rod 29 being pushed out so as to prevent the push rod 29 separating from the cylindrical hole 72. The bottom surface of a threaded base 22 is mounted with a washer 21; after the threaded rod 37 of the connection pipe 36 is engaged with the threaded hole 28 of the threaded base 22, the end of the threaded rod 37 and the bottom surface of the threaded base 22 will be in contact with each other hermetically.

The cylindrical hole 72 of the connection pipe 36 has a threaded base 41, of which the outer end is furnished with a round rod 78 having a threaded hole 68; a punch assembly 49 is mounted in the threaded hole 68. Before the punch assembly 49 being mounted in the threaded hole 68 of the threaded base 41, the cylindrical hole 30 of the push rod 29 should be filled with oil. Before the oil being filled, a rod should be put through the cylindrical hole 43, the threaded hole 44 and the cylindrical hole 30 to push the piston rod 17 to move downwards so as to increase the oil storage space in the cylindrical hole 30. The oil is filled via the threaded hole 44; after the hydraulic chamber 71 is filled fully with oil, there would be no oil to leak because of a leakage-proof structure being furnished between assemblies, such as a ring seal 34 and an O-ring 35 being mounted to the round rod 33 of the push rod 29, a washer 21 being mounted between the threaded rod 37 of the connection pipe 36 and the bottom surface of the threaded base 22, an oil seal 25 and a buffer washer 26 being mounted between the piston rod 17 and the threaded base 22, a threaded bolt 45 mounted with an O-ring 46 being screwed towards cylindrical hole 47 of the push rod 29; the O-ring 46 is considered the last leakage-proof structure of the hydraulic chamber 71.

Before the punch assembly 49 being mounted in place, a power test for the push rod 29 should be done first; in that case, the casing 12 of the metal-work tool 11 is connected with an air compressor so as to have a high pressure air entered a passage on the front end of the control valve 13; the control valve 13 is controlled with the cock 14 so as to have a high pressure air flowed into the chamber 18A of the casing 12. When the piston 16 is pushed with the high pressure air to move, the piston rod 17 will move simultaneously; then, the piston rod 17 in the cylindrical hole 30 of the push rod 29 will push the oil in the hydraulic chamber 71 to move. Since the oil is pressed in a limited space, it will push the push rod 29 to drive the punch assembly 49 with a given force.

Figure 3:
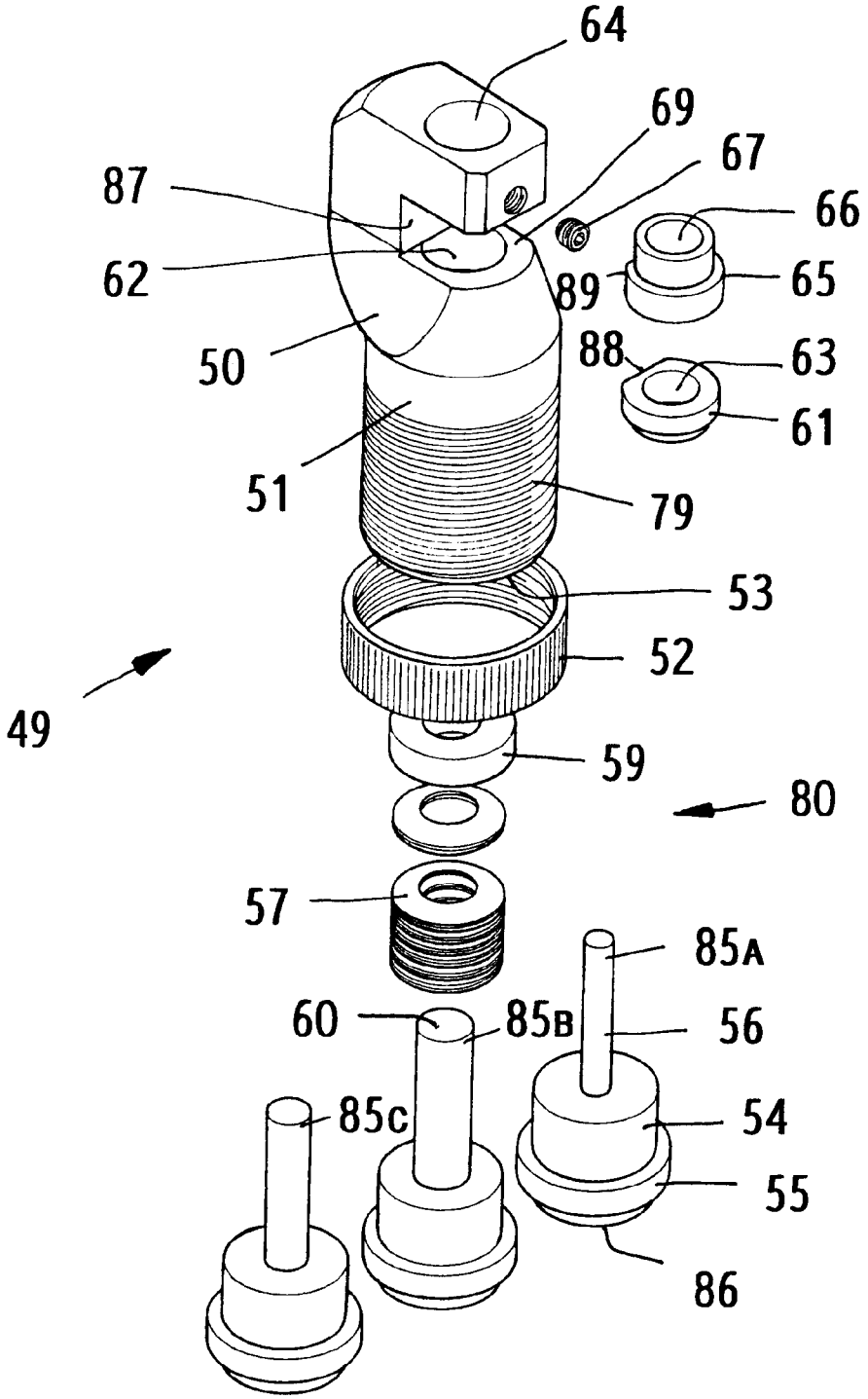
FIG. 3 is a disassembled view of the present invention, showing the related structure of the punch assembly.
Figure 4:
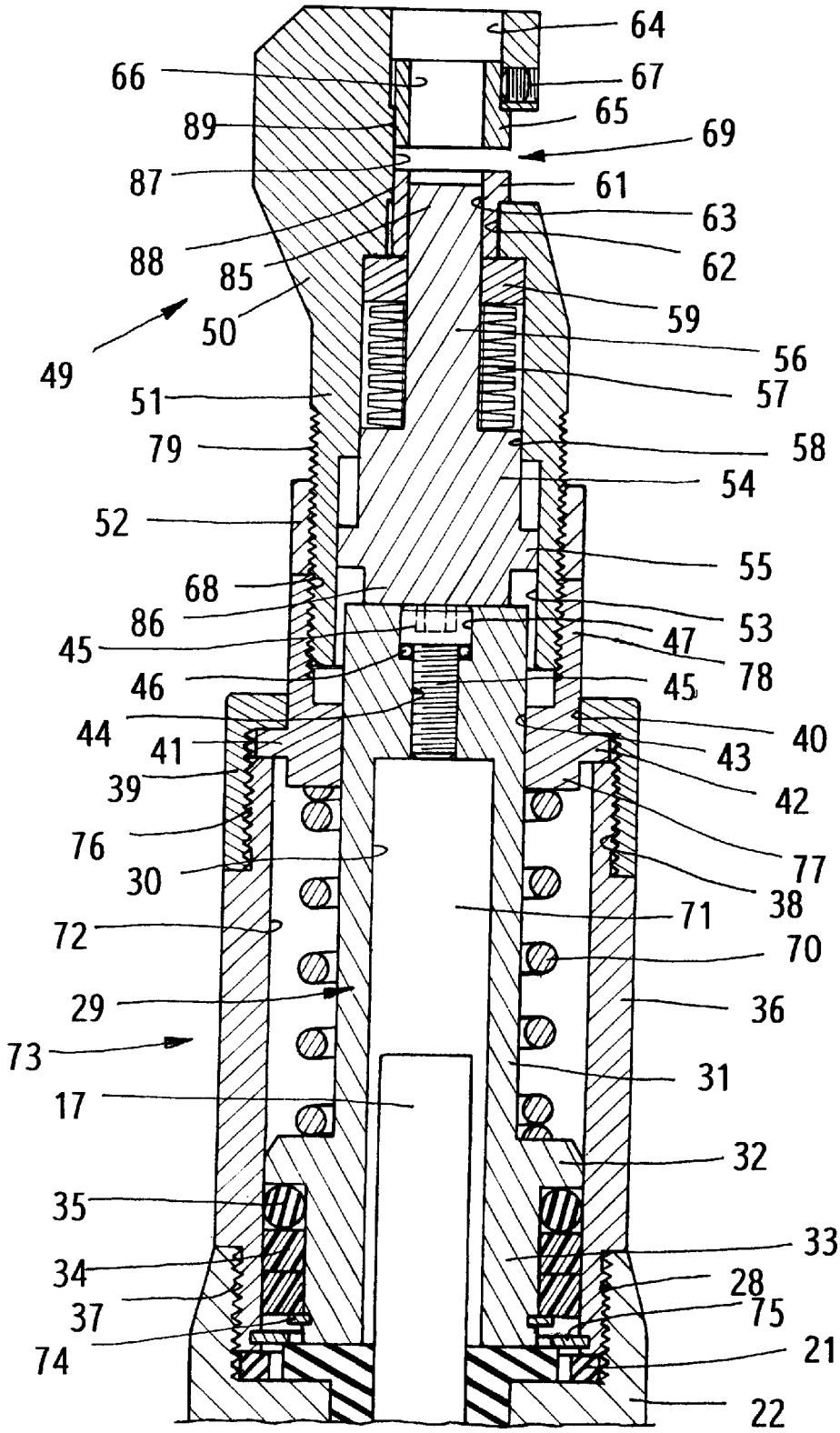
FIG. 4 is a sectional view of the present invention, showing the structure of the punch assembly.
Figure 5:
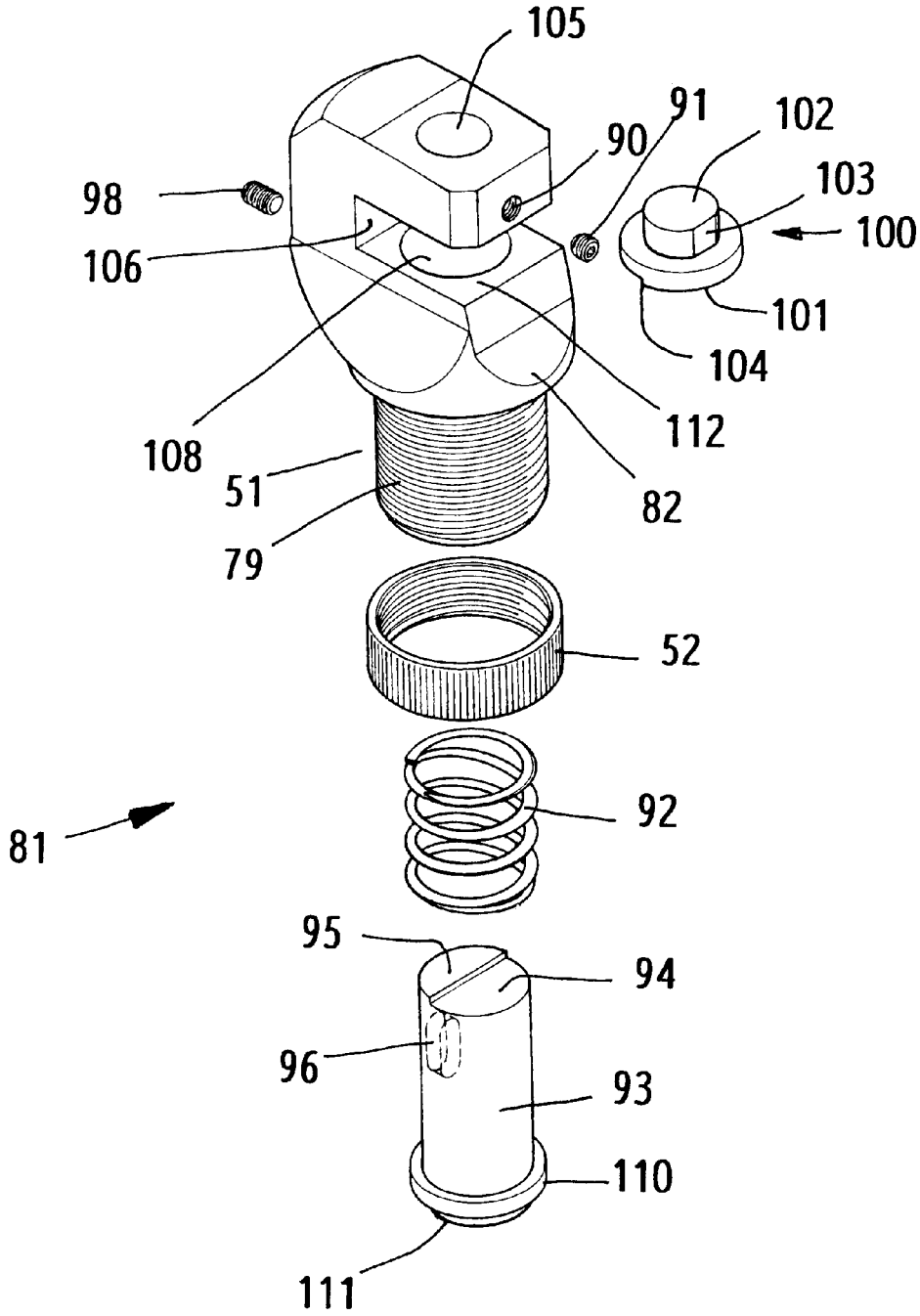
FIG. 5 is a disassembled view of the present invention, showing the related structure of the edging assembly.
Figure 6:
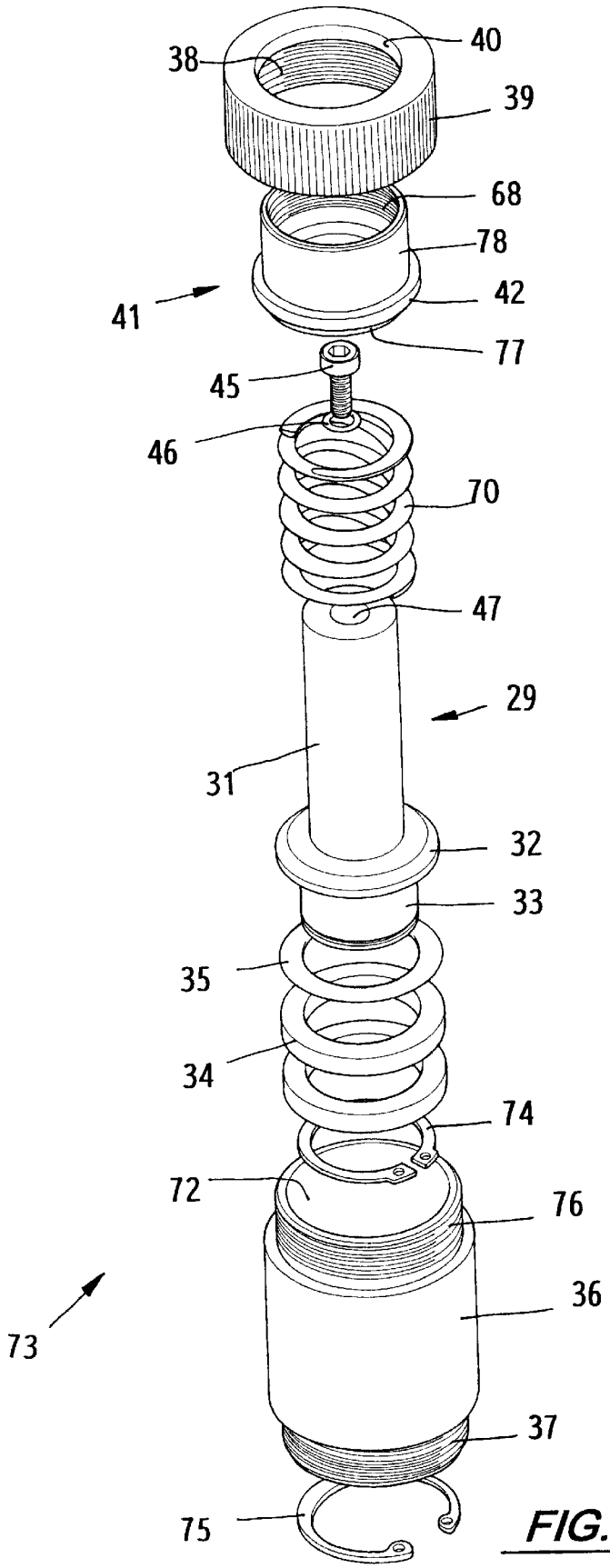
FIG. 6 is a disassembled view of the present invention, showing the structure of the edging assembly.

As shown in FIGS. 2 to 4, the punch assembly 49 mounted on the threaded base 41 is a hole-punch assembly 80, which includes a C-shaped base 50, a punch shaft 56, a spiral spring 57, a positioning plate 59, a guide sleeve 61, a punch base 65 and a threaded positioning ring 52; one end of the C-shaped base 50 has an opening 69 to facilitate punching; both ends of the opening 69 are furnished with two fixed holes 62 and 64 respectively, in which a guide sleeve 61 and a punch base 65 are mounted respectively. Both sides of the bottom surface 87 of the opening 69 in the C-shaped base 50 are furnished with two fixed holes 62 and 64, which are milled into form respectively. The opening 69 has a bottom surface 87, and both ends of the opening 69 are mounted with a guide sleeve 61 and a punch base 65 respectively, of which have flat surfaces 88 and 89 respectively. When the guide sleeve 61 is mounted in the fixed hole 62 on one side of the opening 69, the flat surface 88 of the guide sleeve 61 must be in close contact with the bottom surface 87 of the opening 69 so as to have the outer surface of the guide sleeve 61 faced the fixed hole 62 and fixed in place. When the punch base 65 is mounted in the fixed hole 64 in the opening 69, the flat surface 89 thereof must be in close contact with the bottom surface 87 of the opening 69, and then the punch base 65 is fitted in the fixed hole 64. Upon punching a hole in a metal plate, the punch head 60 of the punch shaft 56 will be pulled back after punching a round hole; to prevent the punch base 68 from dropping upon the punch shaft 56 being pulled back, a screw 67 is mounted in a screw hole beside the fixed hole 64 so as to have the punch base fixed in the fixed hole 64 of the opening 69.

One end of the C-shaped base 50 is furnished with an opening 69, while the other end thereof has a threaded cylinder 79 with a threaded portion 51; a threaded positioning ring 52 is mounted on the threaded cylinder 79. After the threaded cylinder 79 is screwed in the threaded hole 68 of the threaded base 41, the threaded cylinder 79 will be fastened to the threaded base 41 by means of the threaded positioning ring 52. The center of the threaded cylinder 79 is furnished with a cylindrical hole 53, a cylindrical hole 58 and a fixed hole 62; the fixed hole 62 of the opening 69 is mounted with a guide sleeve 61, of which the center has a cylindrical hole 63 for receiving a round shaft 85 of the punch shaft 56; the punch shaft 56 has two guide shafts 54 and 55, which are to be mounted in the cylindrical holes 53 and 58 of the threaded cylinder 79 respectively.

The diameter of the cylindrical hole 53 of the threaded cylinder 79 is slightly larger than that of the round rod 31 of the push rod 29. After the threaded cylinder 79 is screwed in the threaded hole 68 of the threaded base 41, the end of the round rod 31 will extend into the cylindrical hole 53; the cylindrical hole 53 has a length on the surface thereof for guiding the guide shaft 54 to move. The round rod 31 of the push rod 29 has a length for the piston rod 17 to move. The cylindrical hole 58 in the cylindrical hole 53 is an additional guide hole for receiving the guide shaft 55 of the punch shaft 56 to move along the cylindrical hole 58, and for the spiral spring 57 and the positioning plate 59 upon the punch shaft 56 returning.

The punch shaft 56 mounted in the cylindrical holes 53 and 58 of the threaded cylinder 79 includes a short shaft 86, two guide shafts 54 and 55, and a round shaft 85; the diameter of the short shaft 86 is slightly smaller than that of the round rod 31 of the push rod 29; the end thereof is in contact with the end surface of the round rod 31. The guide shafts 54 and 55 are fitted in the cylindrical holes 53 and 58 closely. When the push rod 29 pushes the punch shaft 56 to move, the guide shafts 54 and 55 of the punch shaft 56 will move along the cylindrical holes 53 and 58. The round shaft 85 of the punch shaft 56 is an elongate shaft, of which the end is mounted in the cylindrical hole 63 of the guide sleeve 61. The diameter of the round shaft 85 can be varied with the size between the cylindrical hole 63 of the guide sleeve 61 and the punch hole 66 of the punch base 65, i. e., the round shafts 85 (85A, 85B and 85C) of the punch shaft 56 with different diameters can be replaced.

Before the punch shaft 56 is mounted in the cylindrical hole 53 of the threaded cylinder 79, a punch shaft 56 with a suitable size should be selected; then, the round shaft 85 of the punch shaft 56 is mounted in the spiral spring 57 and the positioning plate 59; a guide sleeve 61 with a suitable size is mounted in the fixed hole 62 of the opening 69 of the C-shaped base 50; a suitable punch base 65 is mounted in the fixed hole 64 on the other end of the opening 69; then, the punch shaft 56 is mounted through the cylindrical holes 53 and 58 of the threaded cylinder 79. After the threaded cylinder 79 is mounted in the threaded hole 68 of the threaded base 41, adjust the direction of the opening 69; after the threaded position ring 52 is screwed in place, the C-shaped base 50 and the threaded base 41 will be fitted and fixed together. After the punch shaft 56 is actuated with the piston rod 17, the oil in the hydraulic chamber 71 will provide a force to drive the push rod 29 to move; finally, the metal sheet mounted between the guide sleeve 61 and the punch base 65 in the opening 69 will be punched with a round hole.

Before the metal work tool 11 being used to punch a hole, select a punch shaft 56 of the punch assembly 49 with a suitable size; the threaded cylinder 79 of the punch assembly 49 is screwed to the threaded base 41 of the hydraulic push-rod assembly 73, and then adjust the direction of the opening 69 of the C-shaped base 50, and fix it in place with the threaded positioning ring 52. Put a metal sheet into the opening 69 of the punch assembly 49, and set it in a space between the guide sleeve 61 and the punch base 65; then, press the cock 14 so as to have high pressure air flowed into the chamber 18A of the casing 12 to drive the piston 16 to move; simultaneously, the piston rod 17 will move in a closed hydraulic chamber 71 saturated with oil; when the oil is pushed with the piston rod 17 in a direction of the moving piston rod 17; only the push rod 29 moves towards the punch assembly 49; then, the air pressure used for pushing the piston 16 and the piston rod 17 will be converted into a hydraulic power to cause the push rod 29 to move toward the punch shaft 56 of the punch assembly 49 so as to punch a hole with a given diameter in the metal sheet.

As soon as the cock 14 is released, the spiral spring 57 at front end of the punch shaft 56 will push the punch shaft 56 back to the original position thereof; then, the spring 70 will push the push rod 29 back; the piston rod 17 in the hydraulic chamber 71 will also be pushed back to its original position in the casing 12. The next punch will be done upon the cock 14 being pushed again.

Whenever the diameter of a hole punched is changed, some parts of the punch assembly 49 will be changed by unscrewing the threaded positioning ring 52 to remove he punch assembly 49 so as to replace a punch shaft 56 with a diameter as required and a related punch assembly 49.

After the metal-work tool 11 is operated for a long time, some oil in the hydraulic chamber 71 will be reduced as a result of normal consumption. The oil can be replenished by removing the punch assembly 49 on the front end of the threaded base 41, removing the threaded bolt 45 on the round rod 31 with a wrench, and pushing the piston rod 17 out with a slender rod so as to increase the space in the hydraulic chamber 71; then, a replenishing tube extends into the hydraulic chamber 71 to replenish a suitable volume of oil, which is better to reach the bottom of the threaded hole 44; the threaded bolt 45 is then mounted in place to prevent any residual air from being left in the hydraulic chamber 71; in that case, the oil in the hydraulic chamber 71 would not be inflated with air bubbles upon being compressed.

When the metal-work tool 11 is not in use, the length of the piston rod 17 extended in hydraulic chamber 71 would not affect the pushing force of the push rod 29; in other words, as long as the piston 16 has a small motion space between the chamber 18A and the chamber 18B, the piston 16 will be able to cause the piston rod 17 to drive the push rod 29 to push the punch assembly 49 to punch a hole, if the hydraulic chamber 71 is filled with sufficient oil.

It is important that the hydraulic chamber 71 in the cylindrical hole 30 of the push rod 29 must be furnished with a complete seal structure with the related parts. The actuation of the punch shaft 56 of the punch assembly 49 is caused by the motion of the piston rod 17 in the hydraulic chamber 71. The high pressure air can only push the piston rod 17 to move at pre-determined distance as a result of the punch shaft 56 only able to be pushed at a limited length; therefore, the length of the piston rod 17 extended into the hydraulic chamber 71 would not affect the punching force upon the hydraulic chamber being inflated, i. e., not causing too high or low; instead, an even and steady hydraulic force will be provided.

As shown in FIGS. 2, 5, 6 and 10, the threaded base 41 on the front end of the hydraulic push-rod assembly 73 is mounted with an edging assembly 81 for edging a metal sheet; the edging assembly 81 includes a punch shaft 93, a spring 92, a C-shaped base 82, and an edge-punching base 100; one end of the C-shaped base 82 has a threaded cylinder 79 to be mounted on the threaded base 41; the center thereof has an opening 112, and one side thereof has a cylindrical hole 105; both sides of the opening 112 are mounted with a punch head 94 and an edge-punching base 100 respectively, between which one end of a metal sheet is inserted. The hydraulic push-rod assembly 73 can provide a power to drive the punch head 94 to the edge-punching base 100 so as to have the edging slot 95 of the punch head 94 engaged with the edging slot 104 of the edge-punching base 100, and to edge one side of a metal sheet which is to be connected flatly with another metal sheet.

One side of the punch shaft 93 of the edging assembly 81 is furnished with a guide slot 96, while the end surface thereof has a punch head 94; the other end thereof is furnished with a guide shaft 110 and a short shaft 111 having a larger diameter; the inner edge of the guide shaft 110 and the shaft surface form into a shoulder, which enables one end of a spring 92 to be mounted in place; after the punch shaft 93 is mounted in the cylindrical hole 108 of the threaded cylinder 79, the other end of the spring 92 is mounted against a shoulder 109 between the cylindrical hole 107 and the cylindrical hole 108; the spring 92 is used for providing a return force for the punch shaft 93 upon each punch.

A guide slot 96 is furnished below the end surface of the punch shaft 93; a threaded hole 99 is furnished at one side of the cylindrical hole 108 to face the guide slot 96 for receiving a screw 98; the screw 98 extends into the guide slot 96 to prevent the punch shaft 93 from rotating and also to provide a direction-guide function for the punch shaft 93.

The top surface of the punch head 94 of the punch shaft 93 is furnished with an edging slot 95, of which the motion is limited with the motion of the punch shaft 93; when the punch shaft 93 moves continuously, the edging slot 95 can have the edge of a metal sheet punched into a straight line.

The other end of the opening 112 of the C-shaped base 82 is furnished with a cylindrical hole 105 for receiving the round rod 102 of the edge-punching base 100; one side of the round rod 102 has a flat surface 103 facing the threaded hole 90; after a screw 91 is mounted in the threaded hole 90, the screw 91 will be n contact with the flat surface 103 to prevent the edge-punching base 100 to rotate unintentionally.

The edge-punching base 100 mounted in the cylindrical hole 105 of the C-shaped base 82 has a round disk 101 with an edging slot 104. There is a gap between the edging slot 104 of the round disk 101 and the edging slot 95 of the punch head 94, and the gap is to facilitate a metal sheet to insert into the opening 112. When the hydraulic punch-rod assembly 73 is operated continuously, one end of a metal sheet will be edged into a long and straight edge.

One end of the opening 112 of the C-shaped base 82 has a cylindrical hole 105 mounted with an edge-punching base 100, while the cylindrical hole 108 on the other end thereof is mounted with a spring 92 and a punch shaft 93 in the threaded cylinder 79; one side of the punch shaft 93 is mounted with a screw 98 to provide a direction-guide function; the threaded cylinder 79 at one end of the C-shaped base 82 is mounted with a threaded positioning ring 52. The edging assembly 81 is to be assembled by means of the threaded cylinder 79 towards the threaded base 41 of the hydraulic push-rod assembly 73; after the direction of the opening 112 of the C-shaped base 82 is adjusted in place, the C-shaped base 82 is fixed in place to set the direction of the opening 112; one end of a metal sheet may be insert into the opening 112 of the C-shaped base 82 to have the end contacted with the bottom surface 106 of the opening 112; then, press the cock 14, and the high pressure air will flow into the piston 16 to cause the piston rod 17 to move so as to convert into a hydraulic force; then, the push rod 29 will drive the punch shaft 93 to move towards the opening 112 so as to complete a punch operation to a metal sheet. After one punch is done, the punch shaft 93 will be pushed to its original position as a result of the spring 92. The cock 14 may be pressed continuously for operation, and the metal sheet in the opening 112 of C-shaped base 82 may be moved along the bottom surface 106 continuously so as to facilitate the punch head 94 of the punch shaft 93 to punch continuously and quickly; then, one side of the metal sheet will have an elongate side edged so as to connect flatly with another metal sheet.

In the pneumatic metal-work tool of the present invention, the front end of the hydraulic push-rod assembly 73 is furnished with a threaded base 41 to be mounted with a punch assembly 80 or an edging assembly 81; different metal-work tool can be mounted in place or replaced with screwing method.

The hydraulic push-rod assembly 73 in the connection pipe 36 extends into the hydraulic chamber 71 by means of the piston rod 17; in that case, the dimensions of the piston rod 17 in the hydraulic chamber 71 would not affect the punch force of the punch rod 29 upon the volume of oil in the hydraulic chamber 71 being changed, i. e., a steady hydraulic pressure can be maintain in the punch hole operation or in edging operation.

The aforesaid detail description has disclosed the features and structure completely of the present invention; it is apparent that the present invention has made an obvious improvement of the kind, which is never anticipated and accomplished by any person in the field; therefore, the structure of the present invention is deemed unique.

What is claimed is:

1. A pneumatic metal-work tool comprising:

a) a piston having a piston rod;

b) a casing assembly having a control valve on a first end and a cylindrical hole receiving the piston and the piston rod on a second end thereof;

c) a hydraulic push-rod assembly including:

i) a first threaded base having a center cylindrical hole and being threadedly connected on a first end to the second end of the casing assembly, the piston rod extending through the cylindrical hole in the first threaded base;

ii) a connection pipe having a center cylindrical hole, and a first end threadedly connected to a second end of the first threaded base;

iii) a second threaded base having a center cylindrical hole, a short rod on a first end inserted into the cylindrical hole of said connection pipe; a ring-shaped plate positioned on the second end of said connection pipe, and a round rod on a second end thereof; the second end thereof having a threaded hole for receiving a punch assembly;

iv) a threaded sleeve having a cylindrical hole and positioned around the second threaded base and threadedly connected to a second end of the connection base, such that ring-shaped plate of the second threaded base is held against the second end of the connection base by the threaded sleeve;

v) a push rod having a ring-shaped plate with a first round rod on a first end thereof, and said first round rod inserted in the cylindrical hole of said threaded sleeve; a second end of said ring-shaped plate having a second round rod; the second end of said push rod having an elongated cylindrical hole defining a hydraulic chamber, the first end thereof having a threaded hole and a cylindrical hole for receiving a threaded bolt;

vi) a spring mounted on the first round rod of said push rod and positioned between said ring-shaped plate of the push rod and said short rod of said second threaded base;

vii) a ring seal and a first O-ring mounted on outer surface of the second round rod of the push rod; a first retaining ring mounted on the second end of the push rod; said ring seal and first O-ring being in close contact with a surface of the cylindrical hole in said connection pipe; and viii) a threaded bolt with a second O-ring mounted in the threaded hole on the first end of said push rod; and d) a punch assembly having a C-shaped base having an opening on a first end with punch guide sleeves mounted on opposing sides thereof; a second end of said C-shaped base threadedly connected to the round rod on the second end of the second threaded base.

2. A pneumatic metal-work tool as claimed in claim 1, further comprising an oil seal and a buffer washer inserted into the center cylindrical hole of the first threaded base; said oil seal and said buffer washer each having a cylindrical hole into which the piston rod is inserted.

3. A pneumatic metal-work tool as claimed in claim 1, wherein said hydraulic chamber of said push rod is filled with oil; all contact surface of said hydraulic chamber being furnished with an oil-leak-proof device; the center cylindrical hole of said first threaded base having a larger hole for receiving said piston rod and for mounting an oil seal and a buffer washer; a seal washer sealing a contact surface between said center cylindrical hole of said first threaded base and said connection pipe; the first round rod on a first end of said ring-shaped plate of said push rod mounted with a ring seal, and a third O-ring which are fastened in place with a second retaining ring.

4. A pneumatic metal-work tool as claimed in claim 1, wherein said punch assembly is a hole-punch assembly comprising:

a) fixed holes in opposing sides of the opening of the C-shaped base for receiving a guide sleeve and a punch base respectively; the second end of the C-shaped base having a threaded cylinder with a cylindrical hole receiving a spiral spring and a punch shaft;

b) the punch shaft including a short shaft, two guide shafts having different diameters, and a round shaft; said short shaft being in contact with the first end of said push rod; said two guide shafts being in contact with two cylindrical holes in the C-shaped base having different diameters respectively; outer end of said round shaft mounted with said spiral spring, and a punch head mounted in said guide sleeve;

c) the spiral spring mounted on said round shaft of said punch shaft;

d) a positioning plate mounted in a cylindrical hole of said threaded cylinder and being in contact with said spiral spring;

e) one of the two guide sleeves mounted in a fixed hole on a first end of said opening, and center thereof having a cylindrical hole for receiving a punch head of said punch shaft;

f) a punch base mounted in a fixed hole on a second end of said opening, and said punch base having a punch hole; and g) a threaded positioning ring mounted on threaded portion of a threaded cylinder of said C-shaped base.

5. A pneumatic metal-work tool comprising:

a) a piston having a piston rod;

b) a casing assembly having a control valve on a first end and a cylindrical hole receiving the piston and the piston rod on a second end thereof;

c) a hydraulic push-rod assembly including:

i) a first threaded base having a center cylindrical hole and being threadedly connected on a first end to the second end of the casing assembly, the piston rod extending through the cylindrical hole in the first threaded base;

ii) a connection pipe having a center cylindrical hole, and a first end threadedly connected to a second end of the first threaded base;

iii) a second threaded base having a center cylindrical hole, a short rod on a first end inserted into the cylindrical hole of said connection pipe; a ring-shaped plate positioned on the second end of said connection pipe, and a round rod on a second end thereof; the second end thereof having a threaded hole for receiving a punch assembly;

iv) a threaded sleeve having a cylindrical hole and positioned around the second threaded base and threadedly connected to a second end of the connection base, such that ring-shaped plate of the second threaded base is held against the second end of the connection base by the threaded sleeve;

v) a push rod having a ring-shaped plate with a first round rod on a first end thereof, and said first round rod inserted in the cylindrical hole of said threaded sleeve; a second end of said ring-shaped plate having a second round rod; the second end of said push rod having an elongated cylindrical hole defining a hydraulic chamber, the first end thereof having a threaded hole and a cylindrical hole for receiving a threaded bolt;

vi) a spring mounted on the first round rod of said push rod and positioned between said ring-shaped plate of the push rod and said short rod of said second threaded base;

vii) a ring seal and a first O-ring mounted on outer surface of the second round rod of the push rod; a first retaining ring mounted on the second end of the push rod; said ring seal and first O-ring being in close contact with a surface of the cylindrical hole in said connection pipe; and viii) a threaded bolt with a second O-ring mounted in the threaded hole on the first end of said push rod; and d) a punch assembly is an edging assembly and includes:

i) an opening at a first end of a C-shaped base; both sides of said opening having a cylindrical hole respectively receiving an edge-punching base and a punch head of said punch shaft; a second end of said C-shaped base furnished with a threaded cylinder, of which a center being furnished with a cylindrical hole for receiving a punch shaft and a spring;

ii) a spring mounted in the cylindrical hole of threaded cylinder of said C-shaped base, and outer end thereof being in contact against a shoulder of a punch shaft;

iii) said punch shaft mounted in said cylindrical hole of said C-shaped base; one end thereof having a short shaft being in contact with the first end of said push rod, while other end thereof having an edging slot on said punch head and facing said opening; and iv) an edge-punching base mounted in the cylindrical hole on an outer side of said opening of said C-shaped base and having a round disk with an edging slot.

6. A pneumatic metal-work tool comprising:

a) a casing assembly, and a hydraulic push-rod assembly; said hydraulic push-rod assembly including:

b) a first threaded base threadedly connected on a first end to an outer end of said casing assembly; a center cylindrical hole thereof for receiving a piston rod inserted into a cylindrical hole of a push rod;

c) a connection pipe having a center cylindrical hole, a first end threadedly connected to a second end of the first threaded base on said casing assembly, while other end thereof being mounted with a threaded base; then, a threaded sleeve mounted on outside thereof;

d) a second threaded base having a center cylindrical hole, a short rod on a first end inserted into the cylindrical hole of said connection pipe; a ring-shaped plate positioned on the second end of said connection pipe; a second end thereof furnished with a threaded hole for receiving a punch assembly;

e) a threaded sleeve having a cylindrical hole and positioned around the second threaded base and threadedly connected to a second end of the connection base, such that ring-shaped plate of the second threaded base is held against the second end of the connection base by the threaded sleeve;

f) a push rod having a ring-shaped plate with a first round rod on a first end, and said first round rod inserted in the cylindrical hole of said threaded sleeve; a second end of said ring-shaped plate having a second round rod; the second end of said push rod having an elongated cylindrical hole defining a hydraulic chamber, while the first end thereof having a threaded hole and a cylindrical hole for receiving a threaded bolt;

g) a spring mounted on the first round rod of said push rod, and positioned between said ring-shaped plate of the push rod and the short rod of said threaded base;

h) a ring seal and a first O-ring mounted on outer surface of the second round rod of the push rod; a first retaining ring mounted on the second end of the push rod; said ring seal and first O-ring being in close contact with a surface of a cylindrical hole in said connection pipe;

i) a threaded bolt with a second O-ring mounted in the threaded hole on the first end of said push rod.

7. A pneumatic metal-work tool comprising:

a casing assembly, a hydraulic push-rod assembly and a punch assembly; said punch assembly being mounted on a second threaded base of said hydraulic push-rod assembly, and said punch assembly including:

a C-shaped base having an opening on a first end and two sides of the opening having fixed holes for receiving a guide sleeve and a punch base respectively; a second end thereof having a threaded cylinder with cylindrical hole for receiving a spiral spring and a punch shaft;

the punch shaft including a short shaft, two guide shafts having different diameters, and a round shaft; said short shaft being in contact with the first end of said push rod; said two guide shafts being in contact with two cylindrical holes in the C-shaped base having different diameters respectively; outer end of said round shaft mounted with said spiral spring, and a punch head mounted in said guide sleeve;

the spiral spring mounted on said round shaft of said punch shaft;

a positioning plate mounted a cylindrical hole of said threaded cylinder, and being in contact with said spiral spring;

the guide sleeve mounted in a first fixed hole on a first side of said opening, and center thereof having a cylindrical hole for receiving a punch head of said punch shaft;

the punch base mounted in a second fixed hole of a second side of said opening, and said punch base having a punch hole; and a threaded positioning ring mounted on a threaded portion of a threaded cylinder of said C-shaped base.

8. A pneumatic metal-work tool comprising:

a casing assembly, a hydraulic push-rod assembly and a punch assembly; said punch assembly being mounted on a second threaded base of said hydraulic push-rod assembly, and said punch assembly including:

a C-shaped base having an opening at a first end thereof; opposing sides of said opening having two cylindrical holes respectively for receiving an edge-punching base and a punch head of said punch shaft; a second end of said C-shaped base furnished with a threaded cylinder, of which a center being furnished with a cylindrical hole for receiving a punch shaft and a spring;

the spring mounted in the cylindrical hole of the threaded cylinder of said C-shaped base, and outer end thereof being in contact against a shoulder of said punch shaft;

the punch shaft mounted in said cylindrical hole of said C-shaped base;

a first end thereof having a short shaft being in contact with the first end of said push rod, while a second end thereof having an edging slot on said punch head and facing said opening; and an edge-punching base mounted in the cylindrical hole on an outer side of said opening of said C-shaped base and having a round disk with an edging slot.

9. A pneumatic metal-work tool as claimed in claim 8, wherein said punch shaft has an elongate guide slot at one side thereof; one side of said C-shaped base having a threaded hole in communication with said cylindrical hole, and said threaded hole to be inserted with a screw extended into said elongated guide slot so as to provide said punch shaft with a direction guide function.

10. A pneumatic metal-work tool as claimed in claim 8, wherein the edge-punching base includes a round rod with a flat surface; one side of said opening of said C-shaped base has a threaded hole for receiving a screw, which contacts said flat surface of said round rod of said edge-punching base so as to fasten said edge-punching base in place without rotation.

* * * * *